United States Patent [19]

Mudgett

[11] 4,335,640

[45] Jun. 22, 1982

[54] SINGLE NOTE SOSTENUTO FOR THE UPRIGHT PIANO

[76] Inventor: Walter A. Mudgett, 2123 Savannah Hwy., Charleston, S.C. 29407

[21] Appl. No.: 192,935

[22] Filed: Oct. 1, 1980

[51] Int. Cl.[3] ..... G10C 3/16

[52] U.S. Cl. ..... 84/218

[58] Field of Search ..... 84/216–218, 84/255, 452 P

[56] References Cited

FOREIGN PATENT DOCUMENTS 12655 12/1880 Fed. Rep. of Germany ..... 84/218

36470 9/1886 Fed. Rep. of Germany ..... 84/255

*Primary Examiner*—Lawrence R. Franklin

[57] ABSTRACT

In the upright piano action, the wire protruding up from the damper lever leaning or biased towards the string contacts and slides back to and forth along a pin fixed and protruding straight out from the hammer spring rail towards the string.

On the sostenuto rod, attached and moveable horizontally on top of the hammer spring rail, is fixed a thin wire arm with a hooked end extending straight towards the space between the strings, reaching just long enough to clear the damper lever wire as it travels horizontally back and forth when the damper is on the string.

When the damper moves off the string after depression of the key, the damper wire slides back along the side of pin in hammer spring rail and is hooked by wire arm on sostenuto rod when it moves horizontally towards the damper wire clamping it securely back, even after release of the depressed key. So long as the sostenuto rod is held in that position, thus allowing the string, after being struck by hammer to continue to vibrate sustaining the tone.

A plurality of such sostenuto wire spring arms and hammer spring rail pins for a plurality of damper levers are fixed to the transversely extending hammer spring rail and sostenuto rod which moves the spring arms in unison toward the damper lever wires catching those that are off the string against the hammer spring rail pins and ignoring those that are on the strings allowing all of the piano action to function normally by moving the spring arms beyond the reach of the damper lever wires.

1 Claim, 5 Drawing Figures

SINGLE NOTE SOSTENUTO FOR THE UPRIGHT PIANO

BACKGROUND OF INVENTION

Sostenutos are known in the art. Generally, these devices comprise a plurality of tabs and wires extended from the lower end of damper levers in combination with a rotatable rail or shaft extending transversely the length of the damper arrangement, fitted with a corresponding plurality of spring stop tabs designed to catch or hold tabs extended from wires fixed to lower end of damper levers on its corresponding spring stop tabs stop side after striking key and depressing piano middle pedal. This action holds damper head off piano string after being hit with hammer allowing it to vibrate or sustain even after release of piano key and at the same time freeing the other damper levers to rotate normally by allowing tabs on damper wires either to flex and bend or spring stop tabs on a rotatable rod to operate on their spring side relieving pressure throughout total of piano action. This also allows the loud or sustaining first pedal and the sostenuto middle pedal to operate damper levers independently and coincidentally, resulting musically as tone or group of sustained tones accompanying a variation of sustained or staccato tones in which neither group of tones mask's or conceals each others clarity.

SUMMARY OF INVENTION

This invention is a device in which a horizontal clamping action is obtained to hold back selected dampers on a piano action by striking selected keys on the piano keyboard and at the same time pressing the middle pedal down. When the keys are struck the piano action causes their corresponding dampers to back away from the strings and as the middle pedal is depressed, the dowel on the middle pedal arm is pushed upwards against the bottom of a rocker arm causing the top of the arm to shift horizontally the sostenuto rod. The damper wires corresponding to the struck selected keys have now backed away from the strings and are situated between the wire spring arms on the sostenuto rod and the pins in the hammer spring rail, thus clamping those dampers back even after release of the keys. This action carries the plurality of spring arms past the plurality of damper wire lines of travel allowing them freedom to operate normally when other keys are struck.

DESCRIPTION OF PREFERRED EMBODIMENTS

Figures 1, 2, 3, 4, 5:
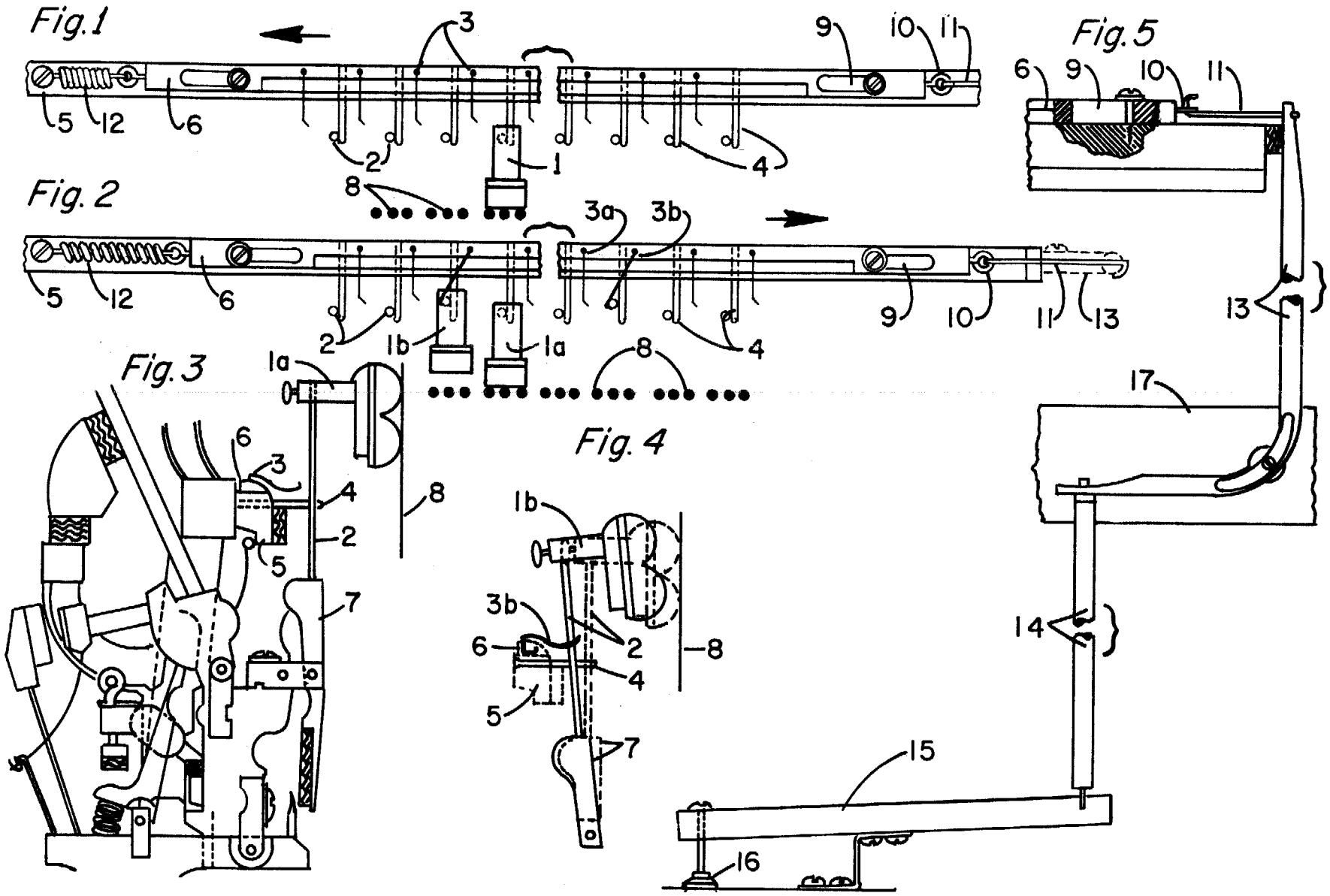
FIG. 1 is a fractional top view partly in section of sostenuto rod on hammer spring rail showing its relative components in OFF position.
FIG. 2 is a top view of FIG. 1 showing its relative components in OFF position and in operation.
FIG. 3 is a fractional side view of FIGS. 1 and 2 showing its relative position in piano action on hammer spring rail with its relative components.
FIG. 4 is a fractional side view of FIGS. 1, 2 and 3 showing relative position in ON or in operation.
FIG. 5 is a fractional back view partly in section and not in porportion of middle pedal arrangement, rocker arm, sostenuto rod and hammer spring rail with sectional view of sostenuto rods slot and attachment to hammer spring rail in REST or OFF position.

There will now be described by reference to the drawing, the basic construction and operation of this sostenuto.

FIG. 1 Shows sostenuto rod (6) as attached to hammer spring rail (5) just tight enough with screws through slots (9) of FIGS. 1, 2, and 5 to allow it to shift horizontally left and right. It is held in off position in FIG. 1 by pull spring (12) which is secured to hammer spring rail (5) and by eyelet hook (10) into the end of sostenuto rod (6).

The plurality of 0.016 wire spring arms (3) are attached and fixed to sostenuto rod (6) of FIGS. 1, 2, 3 & 4, just clearing the plurality of damper wires (2) as they travel left and right with and on rod (6).

Damper wire (2) slides stabilized alongside hammer spring rail pin (4) when damper block (1) is off string (8) when its piano key is struck.

In FIG. 2, operation of the sostenuto is accomplished by depressing a piano key which backs damper (1*b*) off string (8) while at the same time depressing middle pedal (16) of FIG. 5 which rotates up arm (15) pushing dowel (14) against the bottom tip of rocker arm (13) which rotates on a screw in action rail (17) pulling pull-latch (11) attached to eyelet (10) in sostenuto rod (6) sliding it horizontally on hammer spring rail (5) to the right.

This action allows damper wire (2) which has slid back alongside stabilizing hammer spring rail pin (4) of FIGS. 2 & 4 to be clamped and secured back by wire spring arm (3*b*) holding damper block (1*b*) in an off the string (8) position even after the key is released and as long as the middle pedal is depressed.

This action permits damper blocks (1*a*) to move back and forth from string (8) normally as corresponding spring arms (3) are now past damper wires (2) of FIG. 2. FIG. 2 also shows the sostenuto in an on position when the middle pedal is depressed.

Hammer spring rail pin (4) of FIG. 4 is inserted in hammer spring rail (5) through holes drilled and positioned so as to stabilize side pressure on damper wire (2) when it is engaged by spring arm (3*b*) in FIG. 2. It is made of soft iron or brass pointed pins with flaired ends for attachment in hammer spring rail (5) of FIGS. 1, 2, 3, & 4.

Spring arms (3) are inserted in holes in sostenuto rod (6), bent square and stapled up into the bottom of the sostenuto rod. The spring arms are then bent about 95 degrees across rod (6), cut to desired length with the tip bent as shown in FIG. 4.

I claim:

1. A sostenuto mechanism for a piano comprising: a plurality of dampers including damper heads and damper wires aligned adjacent the strings of a piano, a hammer spring rail extending transversely of said dampers opposite said strings, a plurality of rigid pins fixed to said hammer spring rail, each of said pins extending toward said damper wires adjacent the line of movement of an associated damper wire, a sostenuto rod mounted on said hammer spring rail and constrained to move in the longitudinal direction of said hammer spring rail, said rod being biased in a predetermined direction when at rest, a plurality of wire spring arms fixed at one end to said sostenuto rod and extending toward said damper wires, each of said wire spring arms having a hooked end located behind its associated damper wire when the damper wire is in its rest position against its string but extending beyond said damper wire when said damper head is moved away from its string, and means connected to the piano sostenuto pedal for moving said sostenuto rod longitudinally along said hammer spring rail whereby the hooked end of said wire spring arms will catch any associated damper wire which has moved away from its string and hold it against its associated pin but will pass beyond any damper wire which is still at rest.

* * * * *